US009456638B2

(12) United States Patent
Abbott et al.

(10) Patent No.: US 9,456,638 B2
(45) Date of Patent: Oct. 4, 2016

(54) BRA CUP WITH MODESTY PANEL

(71) Applicant: HBI Branded Apparel Enterprises, LLC, Winston-Salem, NC (US)

(72) Inventors: Michael D Abbott, Statesville, NC (US); Roger D Warren, Claremont, NC (US); Richard W Kelley, Germanton, NC (US); David Lackey, Thomasville, NC (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 426 days.

(21) Appl. No.: 13/943,501

(22) Filed: Jul. 16, 2013

(65) Prior Publication Data

US 2015/0024658 A1 Jan. 22, 2015

(51) Int. Cl.

| | |
|---|---|
| ***A41C 3/10*** | (2006.01) |
| ***A41C 3/14*** | (2006.01) |
| *A41C 3/00* | (2006.01) |
| *A61J 13/00* | (2006.01) |

(52) U.S. Cl.

CPC . *A41C 3/14* (2013.01); *A41C 3/10* (2013.01); *A41C 3/005* (2013.01); *A61J 13/00* (2013.01)

(58) Field of Classification Search

CPC ..... A41B 3/00; A41B 3/14; A41B 3/126; A41B 7/00

USPC ..... 450/39, 54–57, 81, 86, 37, 38

See application file for complete search history.

(56) References Cited

U.S. PATENT DOCUMENTS

| | | | | |
|---|---|---|---|---|
| 3,002,516 | A | 10/1961 | Cole | |
| 4,557,267 | A | 12/1985 | Cole | |
| 6,419,548 | B1 | 7/2002 | Wittes et al. | |
| 6,986,696 | B1 | 1/2006 | Jagaric et al. | |
| 7,727,048 | B2 | 6/2010 | Gransberry | |
| 7,815,488 | B2 | 10/2010 | Gransberry | |
| 7,849,715 | B2 | 12/2010 | Starbuck et al. | |
| 8,262,432 | B2 | 9/2012 | Sokolowski | |
| 2001/0008672 | A1* | 7/2001 | Norvell | A41B 11/005 428/90 |
| 2003/0019373 | A1* | 1/2003 | Jordan | A41O 5/00 101/129 |
| 2004/0029485 | A1 | 2/2004 | Pagliarulo et al. | |
| 2005/0208874 | A1 | 9/2005 | Lau | |
| 2008/0274668 | A1 | 11/2008 | Rho | |
| 2010/0319409 | A1* | 12/2010 | Soeda | A41B 17/00 66/176 |
| 2012/0149278 | A1 | 6/2012 | Liu | |

(Continued)

FOREIGN PATENT DOCUMENTS

| | | |
|---|---|---|
| CN | 1012188991 A | 7/2008 |
| FR | 990244 | 6/1951 |

(Continued)

OTHER PUBLICATIONS

Canadian Office Action, Canadian Application No. 2,855,408, Aug. 3, 2015, 3 pages.

(Continued)

*Primary Examiner* — Gloria Hale

(74) *Attorney, Agent, or Firm* — Fish & Richardson P.C.

(57) ABSTRACT

A breast cup for a brassiere, a brassiere, and a method of making the breast cup. The breast cup includes a molded body having an inner surface, an outer surface and an apex. A layer of flock is adhered to the molded body at a location corresponding with the apex in order to provide increased modesty for the breast cup.

33 Claims, 4 Drawing Sheets

(56) References Cited

U.S. PATENT DOCUMENTS

| | | | | |
|---|---|---|---|---|
| 2012/0225607 | A1* | 9/2012 | Martinet | A41C 3/126 450/41 |
| 2015/0024658 | A1* | 1/2015 | Abbott | A41C 3/14 450/39 |

FOREIGN PATENT DOCUMENTS

| | | |
|---|---|---|
| GB | 889496 | 2/1962 |
| TW | 201006398 | 2/2010 |

OTHER PUBLICATIONS

U.S. Appl. No. 13/943,501, filed Jul. 16, 2013, Bra Cup With Modesty Panel, Michael D. Abbott.
U.S. Appl. No. 29/464,987, filed Aug. 22, 2013, Bra Cup With Modesty Panel, Michael D. Abbott.

* cited by examiner

BRA CUP WITH MODESTY PANEL

CROSS-REFERENCE TO RELATED APPLICATION

This application is related to co-pending U.S. Design patent application No. 29/464,987, filed Aug. 22, 2013.

FIELD OF INVENTION

This disclosure relates to undergarments, particularly brassieres. More particularly, this disclosure relates to the breast cups of brassieres that have a modesty panel in the apex of the cups.

BACKGROUND OF THE INVENTION

Conventional brassieres for everyday wear should offer comfort as well as coverage to the wearer. Consumers want to feel comfortable when wearing light weight clothes, yet confident that their undergarments, particularly brassieres, are providing adequate coverage. Bras that are too sheer and thin are not likely to provide the wearer with the desired level of modesty and discretion due to a lack of a sufficiently smooth contour. Bras are alternatively formed with cups containing relatively thick layers of foam. These foam layers provide a smoothly contoured, modest appearance, but significantly increase weight and bulk. Accordingly, there is a need for a bra cup that provides modesty while remaining relatively lightweight and inexpensive to manufacture.

BRIEF DRAWING DESCRIPTIONS

DETAILED DESCRIPTION OF THE DRAWINGS

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
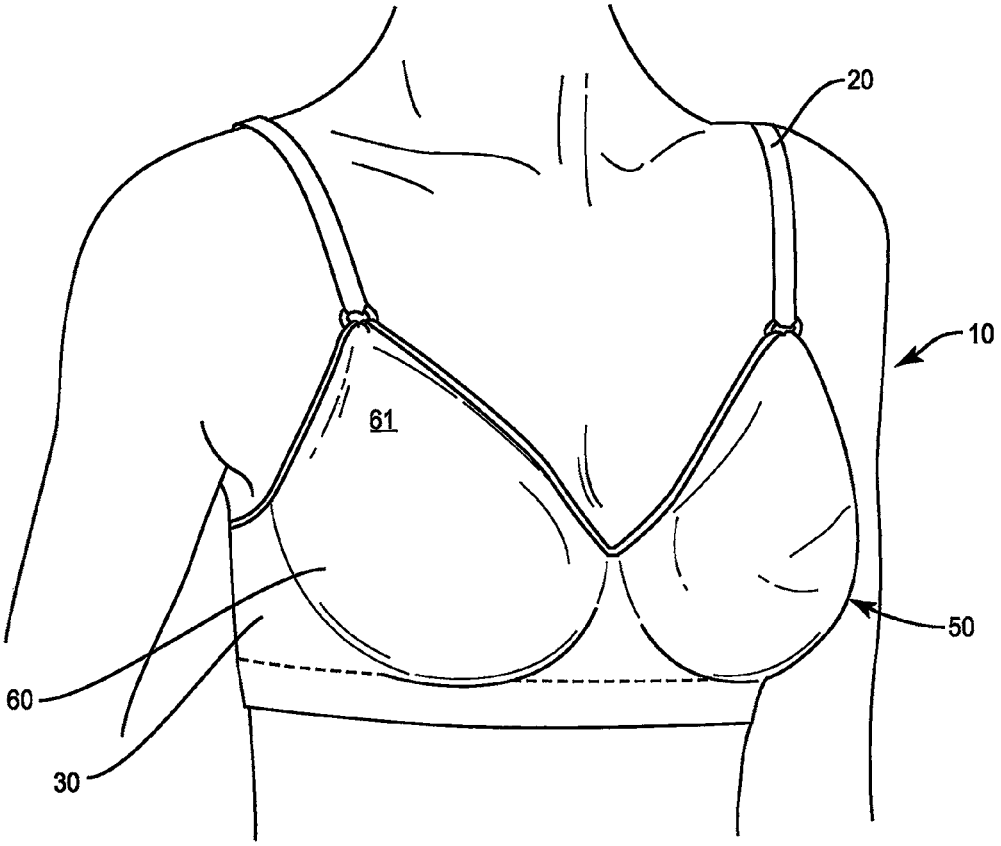
FIG. 1 is an outer perspective view of a brassiere according to embodiments of the present disclosure.

In reference to the drawings and, in particular, to FIG. 1, there is illustrated a brassiere 10 according to embodiments of this disclosure. The brassiere 10 includes a pair of breast cups 50 including the modesty features of this disclosure. The brassiere 10 also may include a pair of shoulder straps 20 and a torso band 30. The brassiere 10 may include fasteners detachably connecting two portions of the torso band or front fasteners detachably connecting the pair of breast cups 50. The outer perspective view of the brassiere 10 in FIG. 1 shows the outer surface 61 of a first ply 60.

As used herein, the term "outer" means the portion of an element that is disposed away from the body or skin of a wearer when the brassieres of the present disclosure are worn. On the other hand, the term "inner" means the portion of an element that is disposed relatively towards the body or skin of a wearer when the brassieres of the present disclosure are worn. Each element of the brassieres, as disclosed herein, should be considered to separately demonstrate an inner and outer portion thereof. As a result, an outer surface may not be visible to an observer since the outer surface may be further covered by additional elements with outer surfaces of their own.

While the breast cups 50 of brassiere 10 may be molded, the present disclosure is not limited to use in connection with bras having rigid molded cups, but may also be used on cups for underwire, strapless, demi-cup, or sports bras. As may be appreciated, each of the pair of breast cups 50 may be separately formed, separately molded or integrally formed or molded as a single panel with two cups having apexes, one for each breast.

Figure 2:
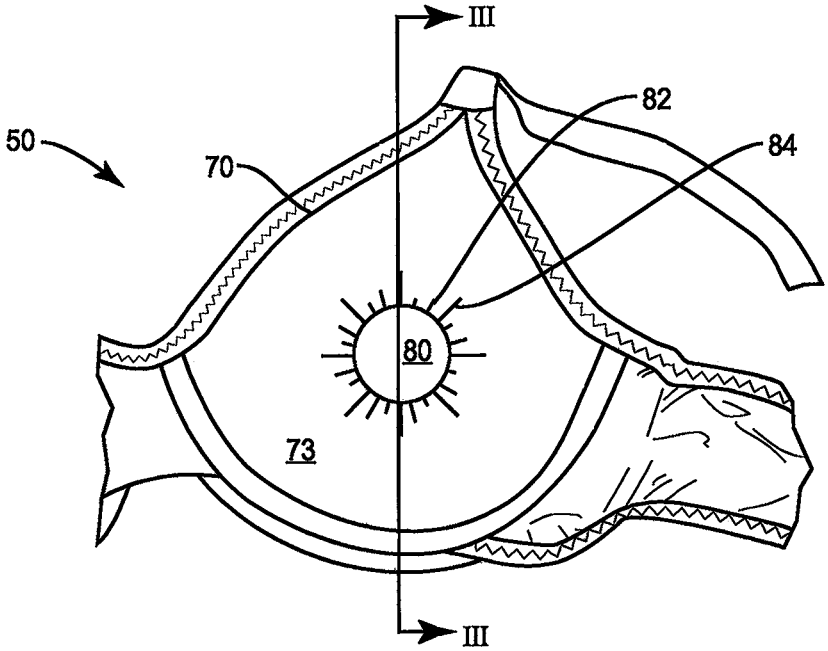
FIG. 2 is an inner perspective view of a cup portion of a brassiere according to some embodiments of the present disclosure.
Figure 3:
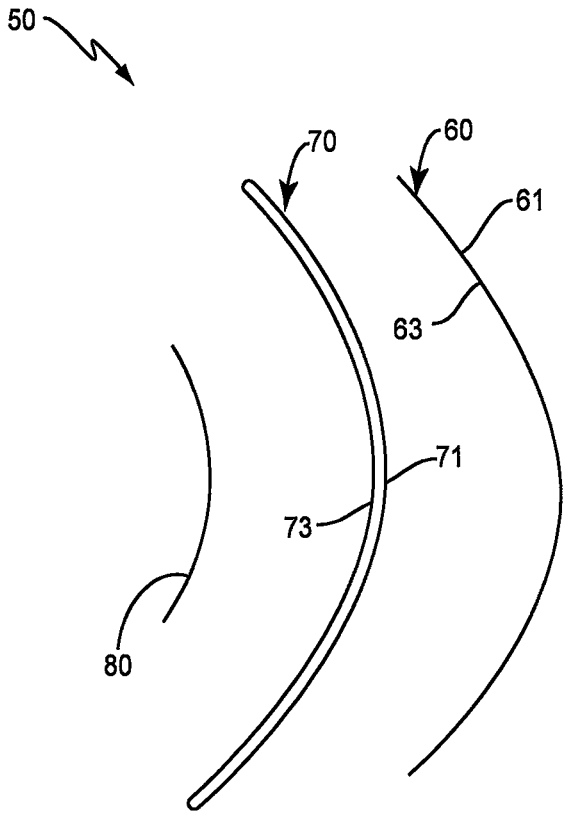
FIG. 3 is an exploded cross section of the cup of FIG. 2.

An exemplary cup of the present disclosure may be understood from FIGS. 2 and 3. FIG. 2 is an inner perspective view of a breast cup 50 of the brassiere 10 shown in FIG. 1, according to some embodiments of the present disclosure. FIG. 3 shows an exploded cross section of the breast cup 50 of FIG. 2. The breast cup 50 shown in FIGS. 2 and 3 is a right cup; as may be appreciated, the left cup would have a structure that mirrors the right cup.

As shown in FIGS. 2 and 3, the breast cup 50 may be formed of a cup assembly comprising a first or outer ply 60, a second or inner ply 70, and a modesty panel 80. The first ply 60 has an outer surface 61 and an inner surface 63; similarly, the second ply 70 has an outer surface 71 and an inner surface 73.

As best shown in FIG. 2, a modesty panel 80 is a layer of material disposed on inner surface 73 of inner ply 70. The modesty panel 80 may alternatively be disposed on an outer surface 71 of the inner ply 70, or on outer surface 61 or the inner surface of the first, outer ply 60.

As also shown in FIG. 2, in one embodiment, the modesty panel 80 may be a layer of material disposed on a surface of a breast cup in a "sun burst" shaped pattern. A sun burst pattern may be thought of as a generally circular shape with a modified periphery. The modified periphery of the sun burst includes at least alternating short 82 and long 84 projections. The sun burst pattern provides an advantageous result for the modesty panel 80. The spaced and alternating projections 82 and 84 increase the flexibility of the bra cup 50 at the apex compared to a purely circular panel. The increased flexibility leads to an increased level of comfort. The periphery of the sun burst pattern also results in a relative blurring of the boundary between the edges of the modesty panel 80 and the remainder of the inner surface 73 of the inner ply 70 of the breast cup 50. The blurred boundary, and disposing the modesty panel 80 on the inner surface 73 of the inner play 70, reduces the visibility of the modesty panel 80, which increases the aesthetics of the brassiere 10.

In one embodiment, the modesty panel 80 is a layer of material that is comprised of flock that is adhered to a surface of the breast cup 50, such as the inner surface 73 of the inner ply 70. As is well known in the field of garments and textiles, the term "flock" refers to any number of materials provided as fine fiber particles to be deposited onto a surface to produce a textured pattern. The process of flocking the breast cup 50 to create the modesty panel 80 may include the use of a high-voltage electric field to electrostatically apply the flock material to a liquid or semi-liquid material, thereby using the liquid or semi-liquid material to adhere the flock to the breast cup 50. The flock may also be applied to the liquid or semi-liquid material by other known means, such as spraying.

The material used for the flock may include nylon, rayon, polypropylene or the like. It is understood that flock necessarily requires relative small fiber sizes. Examples of fibers suitable for flocking include fibers between 0.50 and 1.0 mm in length. The fibers may have a light denier between 1 and 5. An example of suitable fibers includes rayon flocking fibers sold under the Suede-Tex™ mark, which are available from DonJer Products of Winnebago, Ill.

In other embodiments, the layer of material comprising the modesty panel 80 may not be flock at all. Rather, the modesty panel 80 may be formed by applying suede ink to the desired surface of the breast cup 50. The suede ink would provide a similar opaque, textured layer to the desired surface of the breast cup 50.

As discussed above, a liquid or semi-liquid material may be used to adhere the flocked material to a surface of the breast cup 50, such as the inner ply 70. The material may be a curable material, such as liquid silicon rubber, which is available from Dow Corning Corporation of Midland, Mich., and is sold as Product Number 9602. The liquid silicone rubber may be cured by heating, ultraviolet or any other known curing method.

The material may be applied to the selected surface of the breast cup 50 using a variety of techniques. These include: pad printing, screen printing, pouring, extrusion, spraying, and the like. The semi-liquid material may be applied to the selected surface in a pattern configured to represent the shape of the finished modesty panel. As discussed above, in one embodiment, the modesty panel 80 is shaped like a sun burst as shown in FIG. 2.

Turning to FIG. 3, an exploded cross-sectional view of the breast cup of FIG. 2 is shown. The representative breast cup 50 includes a first or outer ply 60 with an outer surface 61 and an inner surface 63, and a second or inner ply 70 with an outer surface 71 and an inner surface 73. In the particular embodiment shown, a layer defining a modesty panel 80 is disposed on the inner surface 73 of the inner or second ply. The modesty panel 80 is positioned relative to the breast cup 50 to correspond with the apex of the breast cup 50.

When applied to the selected surface, the modesty panel 80 provides an increased degree of rigidity to the apex region of the breast cup 50. This increased rigidity provides modesty by maintaining the smooth outer contour of the breast cup 50 while the brassiere 10 is being worn. As discussed above, the modesty panel 80 can be applied to any of the disclosed surfaces 61, 63, 71, 73. Additional plies of fabric may be added outside of the first ply 60 to provide a decorative outer appearance. Although a relatively thin, lightweight construction is desired, additional material may be added between the first and second plies 60, 70 within the scope of this disclosure.

In the embodiment of FIG. 3, the first or outer ply 60 is a liner. The liner is generally understood to be a relatively thin, flexible fabric sheet. The liner may have a pattern or a variety of colors to provide a decorative outer appearance to the brassiere 10. The liner may be woven, non-woven, warp knit or well knit. Example materials used for forming the first ply 60 include polyester, nylon, rayon, polypropylene and cotton.

In the embodiment shown in FIG. 3, the second or inner ply 70 is comprised of a spacer fabric, also known as three-dimensional knit or duplex fabric. A single ply of spacer fabric generally comprises three integrally knit layers, that is, two opposite face layers knit together and spatially separated by a spacer layer of fibers joining the two opposite face layers. A spacer fabric provides a structure for a breast cup 50 that is lighter and has significantly enhanced breathability compared to foam. The spacer fabric also provides more structural stiffness or rigidity than a single layer liner, which allows for the application of the semi-liquid material used to form the modesty panel 80 by adhering flock to a surface of the breast cup. A spacer fabric can be used to form a molded breast cup with less dwell time in the mold as compared to a laminated foam cup. Materials used to create the spacer fabric can include polyester, nylon, rayon, polypropylene and cotton.

Although the embodiment of the breast cup 50 shown in FIG. 3 shows the first ply 60 as a liner and the second ply 70 as a spacer fabric, alternative constructions are within the scope of this disclosure. For example, both the first ply 60 and the second ply 70 may be constructed from single layer liner type fabric. Both the first ply 60 and the second ply 70 may be constructed from multilayer spacer fabric. Also, the first ply 60 may be a spacer fabric while the second ply 70 is a liner fabric. In other embodiments, one of the plies 60, 70 may instead be a laminated foam construction. Even further still, the brassiere 10 may be formed with only one ply without deviating from the scope of this disclosure.

Figure 4:
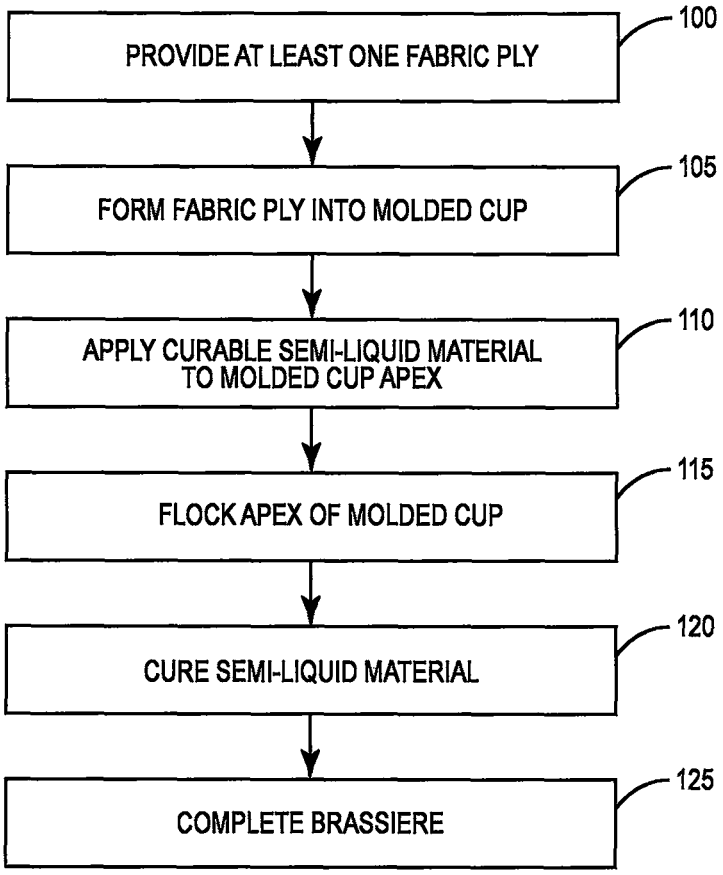
FIG. 4 is a flow chart illustrating a method according to some embodiments of the present disclosure.

FIG. 4 shows a flow chart depicting a method of forming the exemplary breast cup 50 of FIG. 3, according to one embodiment of the present disclosure. In step 100, a fabric ply is provided that will support a modesty panel 80.

In step 105, the provided ply is molded to form a breast cup blank having an apex. The molding step may comprise using a heated bubble/bullet mold or a heated periphery/impression mold to mold the at least one ply for a desired dwell time. In one embodiment, the mold may dwell for no more than one minute, and is preferably dwelled between about 40 and about 50 seconds. The dwell time would be longer if a laminated foam assembly is being used to form the breast cup blank.

After molding in step 105, a liquid or semi-liquid material is applied to the apex of the molded cup in step 110. In a preferred embodiment, the semi-liquid material is applied by screen printing. As discussed above, the material may be a heat curable liquid silicone rubber.

In step 115, the molded cup is flocked. The step of flocking may comprise the use of an electrostatic field or alternative methods such as spraying of the flock. Next, the material is cured at step 120 in order to fix the flock to the molded cup. The step of curing will depend upon the material used, but in one embodiment, where the material is liquid silicone rubber, curing is achieved by with heat.

In step 125, the formation of the brassiere is completed. The completion step may include trimming of the molded cup, addition of a second ply to the inner or outer surface of the molded cup and other well known finishing steps, such as the addition of straps 20.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A brassiere comprising:

a pair of breast cups; and at least one torso strap attached to the breast cups;

wherein each breast cup comprises:

a first ply comprising an inner surface, an outer surface, and an apex, and a modesty panel, comprising a layer of flock, adhered to the inner surface of the first ply, wherein the modesty panel is positioned to be aligned with the apex of the first ply, and wherein the modesty panel is provided in a shape comprising a circle with a periphery and a circumference, and a plurality of projections extending outwardly from the periphery around the circumference of the circle.

2. The brassiere according to claim 1, wherein the flock comprises at least one of rayon, nylon, or polypropylene.

3. The brassiere according to claim 1, wherein the flock comprises fibers having a length of from about 0.5 to about 1.0 mm.

4. The brassiere according to claim 1, wherein the flock is adhered to the inner surface of the first ply using an adhesive material, wherein the adhesive material comprises a liquid silicone rubber.

5. The brassiere according to claim 4, wherein the liquid silicone rubber is heat curable.

6. The brassiere according to claim 1, wherein the first ply comprises a spacer fabric.

7. The brassiere according to claim 6, wherein the spacer fabric comprises at least one of polyester, nylon, rayon, polypropylene, or cotton.

8. The brassiere according to claim 1, wherein each breast cup further comprises a second ply, the second ply comprising a liner fabric having an inner surface and an outer surface, wherein the inner surface of the second ply is in contact with the outer surface of the first ply.

9. The brassiere according to claim 8, wherein the flock is adhered to the outer surface of the second ply.

10. The brassiere according to claim 8, wherein the flock is adhered to the inner surface of the second ply.

11. A breast cup for a brassiere, the breast cup comprising:

a molded breast cup body comprising a spacer fabric and having an inner surface, an outer surface, and an apex; and a modesty panel, comprising a layer of flock, adhered to the inner surface of the molded breast cup body, wherein the modesty panel is positioned along the apex of the molded breast cup body.

12. The breast cup according to claim 11, wherein the flock comprises at least one of rayon, nylon, or polypropylene.

13. The breast cup according to claim 11, wherein the flock comprises fibers having a length of from about 0.5 mm to about 1.0 mm.

14. The breast cup according to claim 11, wherein the flock is adhered to the inner surface of the molded breast cup body using an adhesive material, wherein the adhesive material comprises a liquid silicone rubber.

15. The breast cup according to claim 14, wherein the liquid silicone rubber is heat curable.

16. The breast cup according to claim 11, wherein the spacer fabric comprises at least one of polyester, nylon, rayon, polypropylene, or cotton.

17. The breast cup according to claim 11, further comprising a second ply, the second ply comprising a liner fabric having an inner surface and an outer surface, wherein the inner surface of the second ply is in a contacting relationship with the outer surface of the molded breast cup body.

18. The breast cup according to claim 17, wherein the flock is adhered to the outer surface of the second ply.

19. The breast cup according to claim 17, wherein the flock is adhered to the inner surface of the second ply.

20. The breast cup according to claim 11, wherein the modesty panel is provided in a shape comprising:

a circle with a periphery and a circumference, and alternating long and short projections extending outwardly from the periphery and around the circumference of the circle.

21. A method of forming a breast cup for a brassiere, the method comprising:

molding a base fabric into a breast cup shape having an apex, the base fabric including an inner surface and an outer surface;

applying an adhesive to the inner surface of the base fabric along the apex and in a shape comprising a circle and a plurality of projections extending outwardly from circle; and applying flock to the adhesive applied to the inner surface of the base fabric along the apex and in the shape comprising the circle and the plurality of projections extending outwardly from the circle.

22. The method according to claim 21, wherein applying the flock comprises applying fibers comprising at least one of rayon, nylon, or polypropylene.

23. The method according to claim 21, wherein applying the flock comprises applying fibers having a length of from about 0.5 mm to about 1.0 mm.

24. The method according to claim 21, wherein applying the adhesive to the inner surface of the base fabric comprises applying a liquid silicone rubber adhesive to the inner surface of the base fabric.

25. The method according to claim 24, wherein the liquid silicone rubber adhesive is heat curable, and the method further comprises heating the liquid silicone rubber adhesive.

26. The method according to claim 21, wherein applying the adhesive to the inner surface of the base fabric comprises at least one of screen printing, extruding, or stamping the adhesive onto the inner surface of the base fabric.

27. The method according to claim 21, wherein the base fabric comprises a spacer fabric.

28. The method according to claim 27, wherein the spacer fabric comprises at least one of polyester, nylon, rayon, polypropylene, or cotton.

29. The method according to claim 21, wherein molding the base fabric comprises at least one of perimeter molding and bullet molding.

30. The method according to claim 21, further comprising providing a liner fabric having an inner surface and an outer surface, and molding the liner fabric with the base fabric, so that the inner surface of the liner fabric is in contact with the outer surface of the base fabric.

31. The method according to claim 30, further comprising applying an adhesive to the outer surface of the liner fabric.

32. The method according to claim 30, further comprising applying an adhesive to the inner surface of the liner fabric.

33. A breast cup for a brassiere, the breast cup comprising:

a molded breast cup body having an inner surface, an outer surface, and an apex;

a liner fabric having an inner surface and an outer surface, wherein the inner surface of the liner fabric is in contact with the outer surface of the molded breast cup body; and a modesty panel, comprising a layer of flock, adhered to the inner surface of the molded breast cup body, wherein the modesty panel is positioned along the apex of the molded breast cup body.

* * * * *